US009997115B2

(12) United States Patent
Liu et al.

(10) Patent No.: US 9,997,115 B2
(45) Date of Patent: Jun. 12, 2018

(54) ELECTROPHORETIC DISPLAY APPARATUS AND IMAGE PROCESSING METHOD THEREOF

(71) Applicant: E Ink Holdings Inc., Hsinchu (TW)

(72) Inventors: Shu-Cheng Liu, Taoyuan County (TW); Pei-Lin Tien, Taoyuan County (TW); Chi-Mao Hung, Taoyuan County (TW)

(73) Assignee: E Ink Holdings Inc., Hsinchu (TW)

( * ) Notice: Subject to any disclaimer, the term of this patent is extended or adjusted under 35 U.S.C. 154(b) by 0 days. days.

(21) Appl. No.: 14/813,141

(22) Filed: Jul. 30, 2015

(65) Prior Publication Data

US 2016/0125812 A1 May 5, 2016

(30) Foreign Application Priority Data

Oct. 31, 2014 (TW) ..... 103137835 A

(51) Int. Cl.
*G09G 3/34* (2006.01)

(52) U.S. Cl.
CPC ..... *G09G 3/344* (2013.01); *G09G 2320/0209* (2013.01)

(58) Field of Classification Search
CPC ..... G09G 2320/0285; G09G 2320/041; G09G 3/2007; G09G 3/344
USPC ..... 345/204, 207, 211, 690
See application file for complete search history.

(56) References Cited

U.S. PATENT DOCUMENTS 8,203,547 B2 6/2012 Erol et al.
8,237,733 B2 8/2012 Rhodes
8,355,018 B2 1/2013 Rhodes et al.
8,547,394 B2 10/2013 Swic et al.
2005/0062714 A1 3/2005 Lehner et al.
2007/0206262 A1 9/2007 Zhou
2008/0309648 A1* 12/2008 Erol ..... G09G 3/344 345/204
2009/0046114 A1* 2/2009 Lee ..... G09G 3/2007 345/691
2009/0237351 A1* 9/2009 Kanamori ..... G02F 1/167 345/107
2011/0032227 A1* 2/2011 Miyaguchi ..... G09G 3/344 345/207

(Continued)

FOREIGN PATENT DOCUMENTS

CN 1860513 11/2006
CN 1860514 11/2006

OTHER PUBLICATIONS

"Office Action of China Counterpart Application," dated Feb. 1, 2018, p. 1-p. 7, in which the listed references were cited.

*Primary Examiner* — Tony Davis
(74) *Attorney, Agent, or Firm* — JCIPRNET

(57) ABSTRACT

An electrophoretic display apparatus and an image processing method thereof are provided. The electrophoretic display apparatus includes a display panel and a display driver. The display driver is configured to determine whether a plurality of pixel data of an image signal needs to being recoded according to one or more judgment conditions. If so, the pixel data is recoded. The display driver drives the display panel by using a plurality of driving signals having different signal waveforms, so that the display panel displays an image frame according to pixel data without being recoded and the recoded pixel data.

20 Claims, 7 Drawing Sheets

(56) References Cited

U.S. PATENT DOCUMENTS

| | | | | |
|---|---|---|---|---|
| 2011/0115759 | A1* | 5/2011 | Yamazaki | G09G 3/344 345/204 |
| 2011/0249041 | A1* | 10/2011 | Otsuki | G09G 3/344 345/690 |
| 2011/0267332 | A1* | 11/2011 | Yamazaki | G09G 3/344 345/211 |
| 2011/0285713 | A1 | 11/2011 | Swic et al. | |

* cited by examiner

ELECTROPHORETIC DISPLAY APPARATUS AND IMAGE PROCESSING METHOD THEREOF

CROSS-REFERENCE TO RELATED APPLICATION

This application claims the priority benefit of Taiwan application serial no. 103137835, filed on Oct. 31, 2014. The entirety of the above-mentioned patent application is hereby incorporated by reference herein and made a part of this specification.

BACKGROUND

Technical Field

The invention relates to a display apparatus and an image processing method thereof, and particularly relates to an electrophoretic display apparatus and an image processing method thereof.

Related Art

Due to influences of a manufacturing process and constituent materials, an electrophoretic display apparatus presents a blooming phenomenon of different degrees under different temperature conditions. In a general driving behaviour of the electrophoretic display apparatus, a voltage is applied to pixel electrodes to generate a vertical electric field, so as to drive charged particles to move up and down vertically. When the particles of one color are driven to a viewing zone, a user can observe the color of the pixel. However, a resistance of a solution within the electrophoretic display apparatus is varied along with temperature. The higher the temperature is, the lower the resistance of the solution is, and the charged particles are more liable to be influenced by a horizontal electric field generated by electrodes between the adjacent pixels, such that a moving direction of the charged particles becomes unpredictable. Such phenomenon results in a fact that the charged particles within the pixel move towards other directions besides the vertical direction, and causes a blurring effect in vision, such that a visual effect is influenced, and even correctness of pixel information is influenced.

SUMMARY

The invention is directed to an electrophoretic display apparatus, in which pixel data is recoded to improve display quality.

The invention is directed to an image processing method thereof, which is adapted to an electrophoretic display apparatus, by which pixel data is recoded to improve display quality.

The invention provides an electrophoretic display apparatus including a display panel and a display driver. The display driver is configured to determine whether a plurality of pixel data of an image signal needs to be recoded according to one or more judgment conditions. If the pixel data of the image signal needs to be recoded, the display driver recodes the pixel data. The display driver drives the display panel by using a plurality of driving signals having different signal waveforms, so that the display panel displays an image frame according to the pixel data without being recoded and the recoded pixel data.

In an embodiment of the invention, the one or more judgement conditions include at least one code sequence. The at least one code sequence corresponds to the pixel data of at least a part of pixels in a target detection region of the image frame. The target detection region includes a target detection pixel. The display driver determines whether the pixel data of the target detection pixel needs to be recoded according to the at least one code sequence.

In an embodiment of the invention, the at least a part of pixels include the target detection pixel, and are arranged along a horizontal direction or a vertical direction in the target detection region.

In an embodiment of the invention, the target detection region has one or more pixel widths at each of two sides of the target detection pixel along a vertical direction and has the one or more pixel widths at each of two sides of the target detection pixel along a horizontal direction while taking the target detection pixel as a center.

In an embodiment of the invention, the at least one code sequence represents a gray level relationship between the pixel data of the target detection pixel and the pixel data of pixels adjacent to the target detection pixel.

In an embodiment of the invention, the driving signals include a first driving signal and a second driving signal. The first driving signal includes a first display driving period. The second driving signal includes the first display driving period and a second display driving period.

In an embodiment of the invention, the pixel data without being recoded has a first code number and a second code number. The recoded pixel data has a third code number and a fourth code number. If the pixel data needs to be recoded, the display driver recodes the pixel data having the first code number into the pixel data having the third code number, and recodes the pixel data having the second code number into the pixel data having the fourth code number.

In an embodiment of the invention, during the first display driving period, the display driver drives the display panel to display the pixel data having the first code number and the pixel data having the second code number by using the first driving signal having different signal waveforms.

In an embodiment of the invention, during the first display driving period, the display driver drives the display panel to display the pixel data having the first code number and the pixel data having the third code number by using the first driving signal and the second driving signal having the same signal waveform. During the first display driving period, the display driver drives the display panel to display the pixel data having the second code number and the pixel data having the fourth code number by using the first driving signal and the second driving signal having the same signal waveform.

In an embodiment of the invention, during the second display driving period, the display driver drives the display panel to display the pixel data having the third code number and the pixel data having the fourth code number by using the second driving signal having different signal waveforms.

The invention provides an image processing method for an electrophoretic display apparatus, which includes following steps. An image signal is received. It is determined whether a plurality of pixel data of the image signal needs to be recoded according to one or more judgment conditions. If the pixel data needs to be recoded, the pixel data is recoded. The display panel is driven by using a plurality of driving signals having different signal waveforms, so that the display panel of the electrophoretic display apparatus displays an image frame according to the pixel data without being recoded and the recoded pixel data.

In an embodiment of the invention, the one or more judgement conditions include at least one code sequence. The at least one code sequence corresponds to the pixel data of at least a part of pixels in a target detection region of the image frame. The target detection region includes a target detection pixel. The step of determining whether the pixel data needs to be recoded includes determining whether the pixel data of the target detection pixel needs to be recoded according to the at least one code sequence.

In an embodiment of the invention, the at least a part of pixels include the target detection pixel. The at least a part of pixels are arranged along a horizontal direction or a vertical direction in the target detection region.

In an embodiment of the invention, the target detection region has one or more pixel widths at each of two sides of the target detection pixel along a vertical direction and has the one or more pixel widths at each of two sides of the target detection pixel along a horizontal direction while taking the target detection pixel as a center.

In an embodiment of the invention, the at least one code sequence represents a gray level relationship between the pixel data of the target detection pixel and the pixel data of pixels adjacent to the target detection pixel.

In an embodiment of the invention, the driving signals include a first driving signal and a second driving signal. The first driving signal includes a first display driving period. The second driving signal includes the first display driving period and a second display driving period.

In an embodiment of the invention, the pixel data without being recoded has a first code number and a second code number. The recoded pixel data has a third code number and a fourth code number. The step of recoding the pixel data includes recoding the pixel data having the first code number into the pixel data having the third code number, and recoding the pixel data having the second code number into the pixel data having the fourth code number.

In an embodiment of the invention, the step of driving the display panel to display the pixel data without being recoded by using the first driving signal includes driving the display panel to display the pixel data having the first code number and the pixel data having the second code number by using the first driving signal having different signal waveforms during the first display driving period.

In an embodiment of the invention, the step of driving the display panel to display the pixel data without being recoded by using the first driving signal and driving the display panel to display the recoded pixel data by using the second driving signal includes driving the display panel to display the pixel data having the first code number and the pixel data having the third code number by using the first driving signal and the second driving signal having the same signal waveform during the first display driving period, and driving the display panel to display the pixel data having the second code number and the pixel data having the fourth code number by using the first driving signal and the second driving signal having the same signal waveform during the first display driving period.

In an embodiment of the invention, the step of driving the display panel to display the recoded pixel data by using the second driving signal includes driving the display panel to display the pixel data having the third code number and the pixel data having the fourth code number by using the second driving signal having different signal waveforms during the second display driving period.

According to the above descriptions, in the electrophoretic display apparatus and the image processing method of the invention, it is determined whether to recode the pixel data according to at least one judgement condition, and the driving signals of different waveforms are used to drive the recoded pixel data, so as to improve the display quality.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
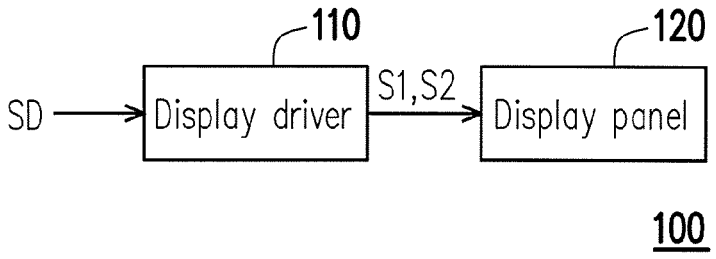
FIG. 1 is a schematic diagram of an electrophoretic display apparatus according to an embodiment of the invention.

FIG. 1 is a schematic diagram of an electrophoretic display apparatus according to an embodiment of the invention. Referring to FIG. 1, the electrophoretic display apparatus 100 of the present embodiment includes a display driver 110 and a display panel 120. In the present embodiment, the display driver 110 determines whether pixel data of an image signal SD needs to be recoded according to one or more judgment conditions. After the determination, if the pixel data of the image signal SD is complied with one of the judgement conditions, it represents that the pixel data needs to be recoded, and the display driver 110 recodes the pixel data. In the present embodiment, the display driver 110 drives corresponding pixels on the display panel 120 by using a first driving signal S1, so as to display the pixel data without being recoded. Moreover, the display driver 110 drives corresponding pixels on the display panel 120 by using a second driving signal S2, so as to display the recoded pixel data. The first driving signal S1 and the second driving signal S2 have different signal waveforms. Namely, in the present exemplary embodiment, the display driver 110 drives the display panel 120 by using a plurality of driving signals (for example, the first driving signal S1 and the second driving signal S2) having different signal waveforms, so that the corresponding pixels on the display panel 120 display an image frame according to the pixel data without being recoded and the recoded pixel data, so as to improve image display quality of the electrophoretic display apparatus 100.

Figure 2:
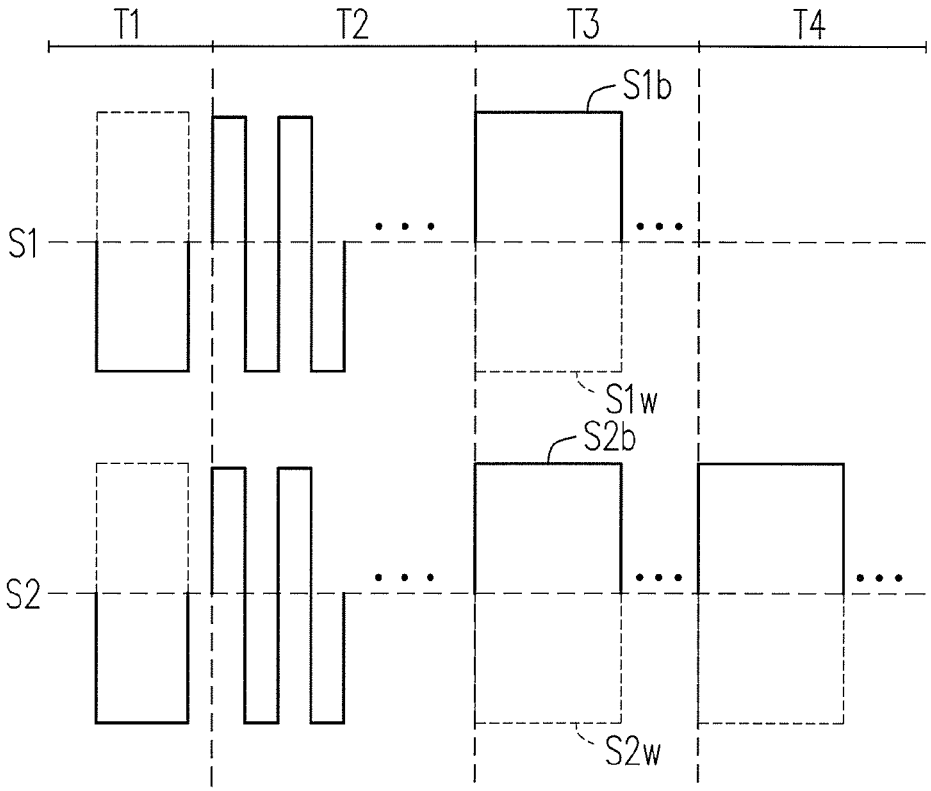
FIG. 2 is a waveform diagram of a plurality of driving signals having different signal waveforms according to an embodiment of the invention.

FIG. 2 is a waveform diagram of a plurality of driving signals having different signal waveforms according to an embodiment of the invention. Referring to FIG. 1 and FIG. 2, the first driving signal S1 includes a first display driving period T3, and the second driving signal S2 includes the first display driving period T3 and a second display driving period T4. During the first display driving period T3, the first driving signal S1 includes different signal waveforms S1*b* and S1*w*. During the first display driving period T3 and the second display driving period T4, the second driving signal S2 includes different signal waveforms S2*b* and S2*w*. In an embodiment, the signal waveform S1*b* of the first driving signal S1 and the signal waveform S2*b* of the second driving signal S2 are, for example, used for driving white pixel data with a higher pixel display gray level. Comparatively, the signal waveform S1*w* of the first driving signal S1 and the signal waveform S2*w* of the second driving signal S2 are, for example, used for driving black pixel data with a lower pixel display gray level, though the invention is not limited thereto.

In other words, in the present embodiment, compared to the first driving signal S1 used for driving pixels to display the pixel data without being recoded, the second driving signal S2 used for driving pixels to display the recoded pixel data further includes the second display driving period T4. During the second display driving period T4, the second driving signal S2 is used for compensating image display quality, such that the recoded pixel data can clearly display its original state information on the pixels of the display panel 120. Besides, in the present embodiment, the first driving signal S1 and the second driving signal S2 all include a direct current (DC) balance period T1 and a refresh period T2. During the DC balance period T1, the display driver 110 performs a DC balance operation to the display panel 120, which is referred to as a energy balancing stage, so as to counteract driving energy to maintain a characteristic of the particles in the solution to an initial state, and remove the influence of time-varying solution viscosity on particle driving. During the refresh period T2, the display driver 110 performs a refresh operation to the display panel 120, which is referred to as an image clearing stage, so as to clear a previous image to avoid a ghost phenomenon.

In the present embodiment, the image signal SD includes a plurality of pixel data, and the pixels on the display panel 120 display an image frame according to the pixel data. In original pixel data, the pixel data is generally coded as a first code number 0 or a second code number 1, and on the display panel 120, the pixel correspondingly displays a white color or a black color. Therefore, in the present embodiment, the pixel data without being recoded has the first code number 0 or the second code number 1. After the determination of the display driver 110, if the original pixel data is complied with one of the judgement conditions of the invention, the display driver 110 recodes the original pixel data to obtain the recoded pixel data. The recoded pixel data has a third code number 2 or a fourth code number 3. In the present embodiment, if the pixel data needs to be recoded, the display driver 110 recodes the pixel data having the first code number 0 into the pixel data having the third code number 2, and recodes the pixel data having the second code number 1 into the pixel data having the fourth code number 3, though the invention is not limited thereto. In the present embodiment, the pixel on the display panel 120 displays the white color or the black color according to the third code number 2 or the fourth code number 3.

During the first display driving period T3, the display driver 110 respectively drives the pixels on the display panel 120 to display the pixel data having the first code number 0 and the pixel data having the second code number 1 by using the first driving signal S1 having different signal waveforms S1*b* and S1*w*, where the pixel data having the first code number 0 and the second code number 1 is the pixel data without being recoded. As shown in FIG. 2, the signal waveform S1*b* of the first driving signal S1 is used for driving the pixels on the display panel 120 to display the black color according to the pixel data having the first code number 0, and the signal waveform S1*w* of the first driving signal S1 is used for driving the pixels on the display panel 120 to display the white color according to the pixel data having the second code number 1.

On the other hand, during the first display driving period T3 and the second display driving period T4, the display driver 110 respectively drives the pixels on the display panel 120 to display the pixel data having the third code number 2 and the pixel data having the fourth code number 3 by using the second driving signal S2 having different signal waveforms S2*b* and S2*w*, where the pixel data having the third code number 2 and the fourth code number 3 is the recoded pixel data. As shown in FIG. 2, the signal waveform S2*b* of the second driving signal S2 is used for driving the pixels on the display panel 120 to display the black color according to the pixel data having the third code number 2, and the signal waveform S2*w* of the second driving signal S2 is used for driving the pixels on the display panel 120 to display the white color according to the pixel data having the fourth code number 3.

Therefore, during the first display driving period T3, the display driver 110 respectively drives the pixels on the display panel 120 to display the pixel data having the first code number 0 and the pixel data having the third code number 2 by using the signal waveform S1*b* of the first driving signal S1 and the signal waveform S2*b* of the second driving signal S2, where the first driving signal S1 and the second driving signal S2 have the same signal waveform. Similarly, the display driver 110 respectively drives the pixels on the display panel 120 to display the pixel data having the second code number 1 and the pixel data having the fourth code number 3 by using the signal waveform S1*w* of the first driving signal S1 and the signal waveform S2*w* of the second driving signal S2, where the first driving signal S1 and the second driving signal S2 have the same signal waveform. Therefore, as shown in FIG. 2, regarding the signal waveforms of the first driving signal S1 and the second driving signal S2 during the first display driving period T3, the signal waveforms used for driving the pixels to display the pixel data having the first code number 0 and the third code number 2 are the same, and the signal waveforms used for driving the pixels to display the pixel data having the second code number 1 and the fourth code number 3 are also the same.

In the present embodiment, a difference between the first driving signal S1 and the second driving signal S2 is that the second driving signal S2 further includes the second display driving period T4. Compared to the first driving signal S1, the signal waveforms S2*b* and S2*w* of the second driving signal S2 continuously drive the pixels to display the pixel data having the third code number 2 and the fourth code number 3 during the second display driving period T4 after the driving waveform of the first display driving period T3 is ended, so as to compensate the image frame to improve the display quality.

Figures 3A, 3B, 3C, 3D, 3E:
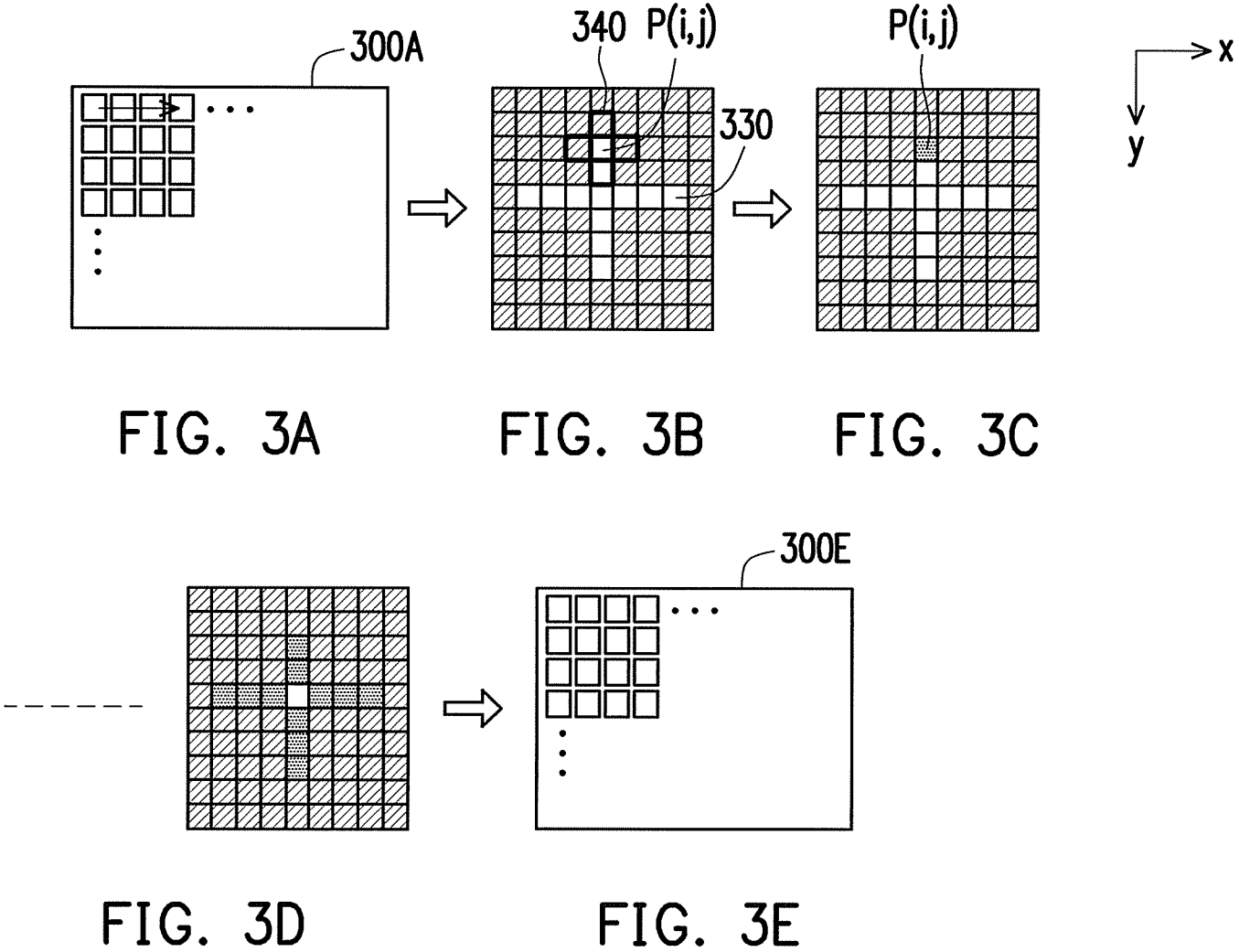
FIGS. 3A-3E illustrate a flow of pixel coding according to an embodiment of the invention.

FIG. 3 illustrates a flow of pixel coding according to an embodiment of the invention, where FIG. 3 includes FIG. 3A to FIG. 3E. FIG. 4 illustrates different patterns of the judgement condition according to an embodiment of the invention, where FIG. 4 includes FIG. 4A to FIG. 4D. Referring to FIG. 3 and FIG. 4, in the present embodiment, x represents a horizontal direction, and y represents a vertical direction. FIG. 3A illustrates an image frame 300A, in which the pixel data thereof is still not recoded. FIG. 3E illustrates an image frame 300E, in which a part of the pixel data has been recoded. FIG. 3B to FIG. 3D respectively illustrate a situation that the display driver 110 sequentially scans each of the pixel data of the image frame. As described above, the display driver 110 determines whether the pixel data of the image signal SD needs to be recoded according to one or more judgment conditions, and if so, the display driver 110 recodes the pixel data.

In the present embodiment, FIG. 3B illustrates an image region 330 and a target detection region 340. The target detection region 340 includes a target detection pixel P(i,j). The target detection region 340 has a width of one pixel, i.e. one pixel width, at each of the upper side and the lower side along the vertical direction y and has a width of one pixel, i.e. one pixel width, at each of the right side and the left side along the horizontal direction x while taking the target detection pixel P(i,j) as a center, though the invention is not limited thereto. In other embodiments, the target detection region 340 may have a width of two or more pixels, i.e. more than one pixel widths, at each of two different sides of the target detection pixel P(i,j) along different pixel arranging directions while taking the target detection pixel P(i,j) as a center.

In the present embodiment, the one or more judgement conditions used by the display driver 110 for determining whether the pixel data needs to be recoded include at least one code sequence. The code sequence corresponds to pixel data of at least a part of pixels in the target detection region 340. Taking the width of one pixel as an example, the one or more judgment conditions of the present embodiment are shown in following table 1 and table 2:

TABLE 1

| Horizontal direction x | Pixel data of target detection region | | | | | Recoded pixel |
|---|---|---|---|---|---|---|
| Part of target detection region | P(i − 2, j) | P(i − 1, j) | P(i, j) | P(i + 1, j) | P(i + 2, j) | data P(i, j) |
| First horizontal code sequence | | 1 | 0 | 1 | | 2 |
| Second horizontal code sequence | | 0 | 1 | 0 | | 3 |

TABLE 2

| Vertical direction x | Pixel data of target detection region | | | | | Recoded |
|---|---|---|---|---|---|---|
| Part of target detection region | P(i, j − 2) | P(i, j − 1) | P(i, j) | P(i, j + 1) | P(i, j + 2) | pixel data P(i, j) |
| First vertical code sequence | | 1 | 0 | 1 | | 2 |
| Second vertical code sequence | | 0 | 1 | 0 | | 3 |

Figure 4A:
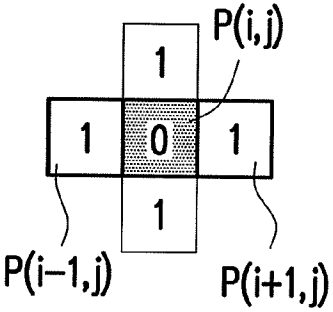
FIGS. 4A-4D illustrate different patterns of judgement condition according to an embodiment of the invention.

Taking the first horizontal code sequence 101 of the table 1 as an example, it represents that original codes of the pixel data of a part of the pixels P(i−1,j), P(i,j), P(i+1,j) in the target detection region are respectively 1, 0, 1, where P(i,j) is the target detection pixel. FIG. 4A illustrates a performance pattern of the first horizontal code sequence 101 serving as the judgement conditions in the target detection region 340. Therefore, when the pixel data of the target detection pixel P(i,j) is 0, and the pixel data of the pixels located adjacent to the target detection pixel P(i,j) to the left and right by the width of one pixel are all 1, the display driver 110 determines that the target detection pixel P(i,j) needs to be recoded, and recodes the target detection pixel P(i,j) with the original pixel data of 0 into the pixel data of 2. Namely, as show in FIG. 4A, the target detection region 340 includes the pixel P(i+1,j) and the pixel P(i−1,j) horizontally adjacent to the target detection pixel P(i,j), and the pixels P(i+1,j) and P(i−1,j) respectively have the width of one pixel along the horizontal direction. According to the judgement conditions of the first horizontal code sequence 101 of the table 1, it is known that in case that the pixels P(i+1,j) and P(i−1,j) have the second code number 1, the target detection pixel P(i,j) having the first code number 0 is recoded to have the third code number 2.

Figure 4B:
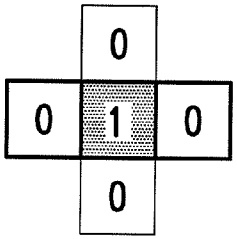

FIG. 4B illustrates a performance pattern of the second horizontal code sequence 010 serving as the judgement conditions in the target detection region 340. Therefore, when the pixel data of the target detection pixel P(i,j) is 1, and the pixel data of the pixels located adjacent to the target detection pixel P(i,j) to the left and right by the width of one pixel are all 0, the display driver 110 determines that the target detection pixel P(i,j) needs to be recoded, and recodes the target detection pixel P(i,j) with the original pixel data of 1 into the pixel data of 3. Namely, as show in FIG. 4B, according to the judgement conditions of the second horizontal code sequence 010 of the table 1, in case that the pixels P(i+1,j) and P(i−1,j) have the first code number 0, the target detection pixel P(i,j) having the second code number 1 is recoded to have the fourth code number 3.

Figure 4C:
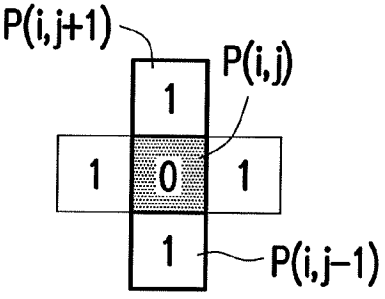

Taking the first vertical code sequence 101 of the table 2 as an example, it represents that the original codes of the pixel data of a part of the pixels P(i,j−1), P(i,j), P(i,j+1) in the target detection region are respectively 1, 0, 1, where P(i,j) is the target detection pixel. FIG. 4C illustrates a performance pattern of the first vertical code sequence 101 serving as the judgement conditions in the target detection region 340. Therefore, when the pixel data of the target detection pixel P(i,j) is 0, and the pixel data of the pixels located adjacent to the target detection pixel P(i,j) to the left and right by the width of one pixel are all 1, the display driver 110 determines that the target detection pixel P(i,j) needs to be recoded, and recodes the target detection pixel P(i,j) with the original pixel data of 0 into the pixel data of 2. Namely, as show in FIG. 4C, the target detection region 340 further includes the pixel P(i,j−1) and the pixel P(i,j+1) vertically adjacent to the target detection pixel P(i,j), and the pixels P(i,j−1) and P(i,j+1) respectively have the width of one pixel along the vertical direction. According to the judgement conditions of the first vertical code sequence 101 of the table 2, it is known that in case that the pixels P(i,j−1) and P(i,j+1) have the second code number 1, the target detection pixel P(i,j) having the first code number 0 is recoded to have the third code number 2.

Figure 4D:
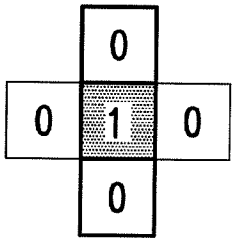

FIG. 4D illustrates a performance pattern of the second vertical code sequence 010 serving as the judgement conditions in the target detection region 340. Therefore, when the pixel data of the target detection pixel P(i,j) is 1, and the pixel data of the pixels located adjacent to the target detection pixel P(i,j) to the left and right by the width of one pixel are all 0, the display driver 110 determines that the target detection pixel P(i,j) needs to be recoded, and recodes the target detection pixel P(i,j) with the original pixel data of 1 into the pixel data of 3. Namely, as show in FIG. 4D, according to the judgement conditions of the second vertical code sequence 010 of the table 2, in case that the pixels P(i,j−1) and P(i,j+1) have the first code number 0, the target detection pixel P(i,j) having the second code number 1 is recoded to have the fourth code number 3.

Therefore, according to the table 1 and the table 2, the code sequences serve as a plurality of judgement conditions of the present embodiment, and as long as the target detection pixel P(i,j) satisfies one of the judgement conditions, for example, as long as the target detection pixel P(i,j) satisfies one of the code sequences of the horizontal direction or the vertical direction, the display driver 110 accordingly determines that the target detection pixel P(i,j) needs to be recoded.

In FIG. 3B, the display driver 110 determines whether the target detection pixel P(i,j) in the target detection region 340 needs to be recoded according to a plurality of judgement conditions shown in the table 1 and the table 2. Therefore, in FIG. 3C, the target detection pixel P(i,j) displays the black color after recoding. Then, the display driver 110 determines whether the pixel data corresponding to the other display region of the image frame 300A needs to be recoded according to the judgement conditions shown in the table 1 and the table 2. The other display region includes but is not limited to other pixels of the image region 330. FIG. 3D illustrates a result that determinations of the other pixels of the image region 330 are completed, and at least a part of the pixel data is recoded. FIG. 3E illustrates an image frame 300E obtained by recoding a part of the pixel data of the image frame 300A of FIG. 3A. It should be noticed that a scan determination direction indicated in the image frame 300A of FIG. 3A is only an example, which is not used for limiting the invention.

Figures 5A, 5B, 5C, 5D, 5E:
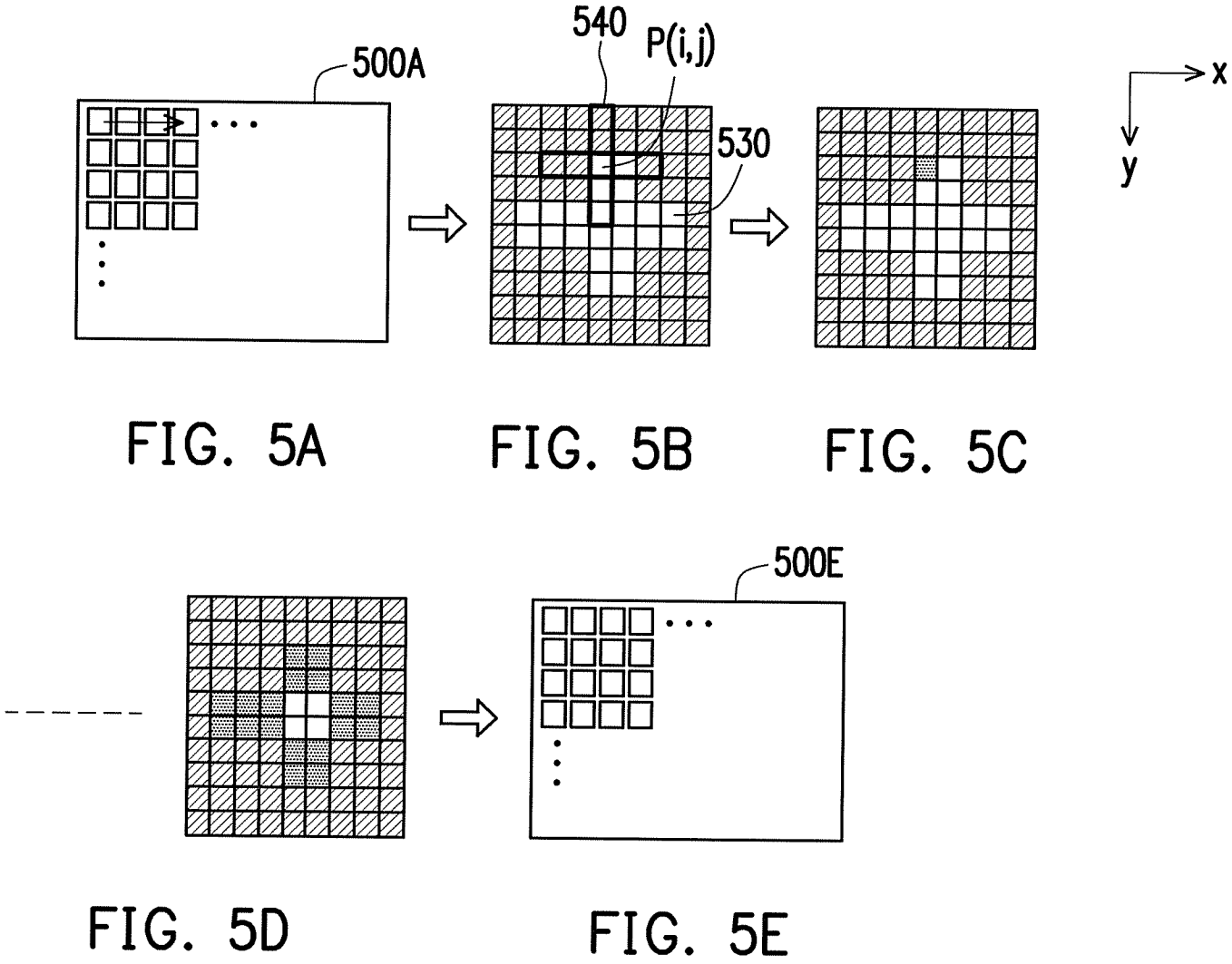
FIGS. 5A-5E illustrate a flow of pixel coding according to another embodiment of the invention.

FIG. 5 illustrates a flow of pixel coding according to another embodiment of the invention, where FIG. 5 includes FIG. 5A to FIG. 5E. FIG. 6 illustrates different patterns of the judgement condition according to another embodiment of the invention, where FIG. 6 includes FIG. 6A to FIG. 6H. Referring to FIG. 5 and FIG. 6, the flow of pixel coding of the present embodiment is similar to the flow of pixel coding of FIG. 3, though a difference there between is that the target detection region 540 of the present embodiment has a width of two pixels, i.e. two pixel widths, at each of the two different sides of the target detection pixel P(i,j) along different pixel arranging directions while taking the target detection pixel P(i,j) as a center.

In detail, in the present embodiment, the target detection region 540 has a width of two pixels at each of the upper side and the lower side along the vertical direction y and has a width of two pixels at each of the right side and the left side along the horizontal direction x while taking the target detection pixel P(i,j) as the center. FIG. 5A illustrates an image frame 500A, in which the pixel data thereof is still not recoded. FIG. 5E illustrates an image frame 500E, in which a part of the pixel data has been recoded. FIG. 5B to FIG. 5D respectively illustrate a situation that the display driver 110 sequentially scans each of the pixel data of the image frame. As described in the embodiment of FIG. 3, the display driver 110 determines whether the pixel data of the image signal SD needs to be recoded according to one or more judgment conditions, and if so, the display driver 110 recodes the pixel data.

In the present embodiment, the one or more judgement conditions used by the display driver 110 for determining whether the pixel data needs to be recoded include at least one code sequence. The code sequence corresponds to pixel data of at least a part of pixels in the target detection region 540. Taking the width of two pixels as an example, the one or more judgment conditions of the present embodiment are shown in following table 3 and table 4:

TABLE 3

| Horizontal direction x | Pixel data of target detection region | | | | | Recoded pixel |
|---|---|---|---|---|---|---|
| Part of target detection region | P(i − 2, j) | P(i − 1, j) | P(i, j) | P(i + 1, j) | P(i + 2, j) | data P(i, j) |
| First horizontal code sequence | | 0 | 1 | 1 | 0 | 3 |
| Second horizontal code sequence | 0 | 1 | 1 | 0 | | 3 |
| Third horizontal code sequence | | 1 | 0 | 0 | 1 | 2 |
| Fourth horizontal code sequence | 1 | 0 | 0 | 1 | | 2 |

TABLE 4

| Vertical direction y | Pixel data of target detection region | | | | | Recoded |
|---|---|---|---|---|---|---|
| Part of target detection region | P(i, j − 2) | P(i, j − 1) | P(i, j) | P(i, j + 1) | P(i, j + 2) | pixel data P(i, j) |
| First vertical code sequence | | 0 | 1 | 1 | 0 | 3 |
| Second vertical code sequence | 0 | 1 | 1 | 0 | | 3 |
| Third vertical code sequence | | 1 | 0 | 0 | 1 | 2 |
| Fourth vertical code sequence | 1 | 0 | 0 | 1 | | 2 |

Figure 6A:
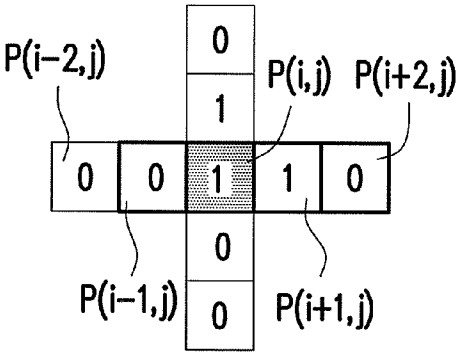
FIGS. 6A-6H illustrate different patterns of judgement condition according to another embodiment of the invention.

Taking the first horizontal code sequence 0110 of the table 3 as an example, it represents that original codes of the pixel data of a part of the pixels P(i−1,j), P(i,j), P(i+1,j), P(i+2,j) in the target detection region are respectively 0, 1, 1, 0, where P(i,j) is the target detection pixel. FIG. 6A illustrates a performance pattern of the first horizontal code sequence 0110 serving as the judgement conditions in the target detection region 540. Therefore, when the pixel data of the target detection pixel P(i,j) is 1, and the pixel data of the pixel P(i−1,j) located to the left and adjacent to the target detection pixel P(i,j) is 0, and the pixel data of two pixels P(i+1,j) and P(i+2,j) located to the right and adjacent to the target detection pixel P(i,j) is respectively 1 and 0, the display driver 110 determines that the target detection pixel P(i,j) needs to be recoded, and recodes the target detection pixel P(i,j) with the original pixel data of 1 into the pixel data of 3. It should be noticed that in the present embodiment, the pixel located to the left of the target detection pixel P(i,j) by a width of two pixels along the horizontal direction further includes the pixel P(i−2,j). However, in the present embodiment, regardless whether the pixel data of the pixel P(i−2,j) is 0 or 1, the pixel data of the pixel P(i−2,j) is not included in the judgement conditions of the table 3, and the pixel data (0) of the pixel P(i−2,j) shown in FIG. 6A is only an example, and the invention is not limited thereto. Therefore, along the horizontal direction x, the judgement conditions used for determining whether the target detection pixel P(i,j) needs to be recoded may only include a part of pixel data of the target detection region 540 along the horizontal direction x. Namely, as show in FIG. 6A, the target detection region 640 includes the pixels P(i−2,j), P(i−1,j), P(i+1,j) and P(i+2,j) horizontally adjacent to the target detection pixel P(i,j). According to the judgement conditions of the first horizontal code sequence 0110 of the table 3, it is known that in case that a part of the pixels in the target detection region i.e. the pixels P(i−1,j), P(i+1,j) and P(i+2,j) satisfy following conditions: the pixel data of the pixels P(i−1,j) and P(i+2,j) are 0 and the pixel data of the pixel P(i+1,j) is 1, the target detection pixel P(i,j) having the second code number 1 is recoded to have the fourth code number 3.

Figure 6B:
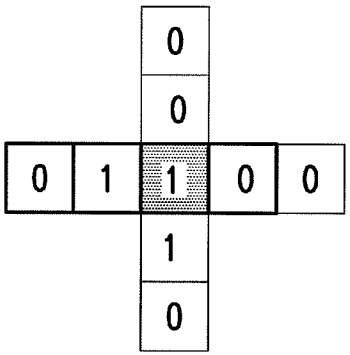
Figure 6C:
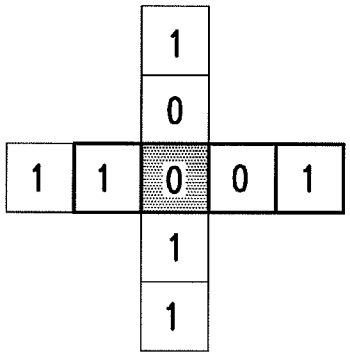

FIG. 6C illustrates a performance pattern of the third horizontal code sequence 1001 serving as the judgement conditions in the target detection region 540. Therefore, when the pixel data of the target detection pixel P(i,j) is 0, and the pixel data of the pixel P(i−1,j) located to the left and adjacent to the target detection pixel P(i,j) is 1, and the pixel data of two pixels P(i+1,j) and P(i+2,j) located to the right and adjacent to the target detection pixel P(i,j) is respectively 0 and 1, the display driver 110 also determines that the target detection pixel P(i,j) needs to be recoded, and recodes the target detection pixel P(i,j) with the original pixel data of 0 into the pixel data of 2. Namely, according to the judgement conditions of the third horizontal code sequence 1001 of the table 3, in case that a part of the pixels in the target detection region i.e. the pixels P(i−1,j), P(i+1,j) and P(i+2,j) satisfy following conditions: the pixel data of the pixels P(i−1,j) and P(i+2,j) are 1 and the pixel data of the pixel P(i+1,j) is 0, the target detection pixel P(i,j) having the first code number 0 is recoded to have the third code number 2.

Figure 6D:
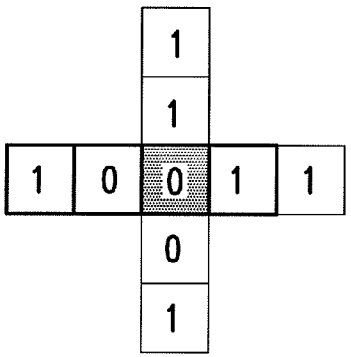

Moreover, regarding the operation method that the display driver determines whether the target detection pixel P(i,j) needs to be recoded by using the second horizontal cod sequence and the fourth horizontal code sequence shown in FIG. 6B and FIG. 6D, since those skilled in the art can learn enough instructions and recommendations of the above operation method from the descriptions of the embodiment of FIG. 6A and FIG. 6C, detailed description thereof is not repeated.

Figure 6E:
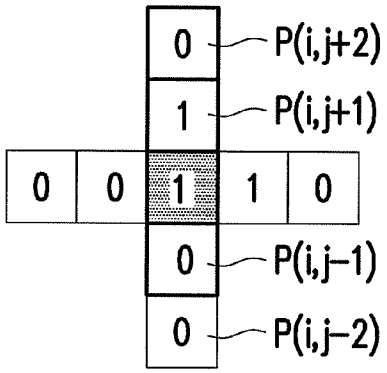

Taking the first vertical code sequence 0110 of the table 4 as an example, it represents that the original codes of the pixel data of a part of the pixels P(i,j−1), P(i,j), P(i,j+1), P(i,j+2) in the target detection region are respectively 0, 1, 1, 0, where P(i,j) is the target detection pixel. FIG. 6E illustrates a performance pattern of the first vertical code sequence 0110 serving as the judgement conditions in the target detection region 540. Therefore, when the pixel data of the target detection pixel P(i,j) is 1, and the pixel data of the pixel P(i,j−1) located below and adjacent to the target detection pixel P(i,j) is 0, and the pixel data of the two pixels P(i,j+1) and P(i,j+2) located above and adjacent to the target detection pixel P(i,j) are respectively 1 and 0, the display driver 110 determines that the target detection pixel P(i,j) needs to be recoded, and recodes the target detection pixel P(i,j) with the original pixel data of 1 into the pixel data of 3. Namely, according to the judgement conditions of the first vertical code sequence 0110 of the table 4, it is known that in case that a part of the pixels in the target detection region i.e. the pixels P(i,j−1), P(i,j+1) and P(i,j+2) satisfy following conditions: the pixel data of the pixels P(i,j−1) and P(i,j+2) are 0 and the pixel data of the pixel P(i,j+1) is 1, the target detection pixel P(i,j) having the second code number 1 is recoded to have the fourth code number 3.

Figure 6F:
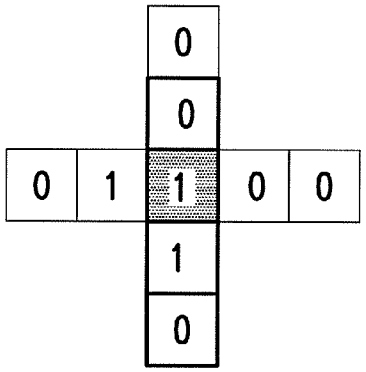
Figure 6G:
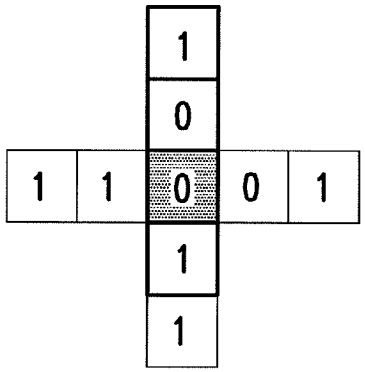

FIG. 6G illustrates a performance pattern of the third vertical code sequence 1001 serving as the judgement conditions in the target detection region 540. Therefore, when the pixel data of the target detection pixel P(i,j) is 0, and the pixel data of the pixel P(i,j−1) located below and adjacent to the target detection pixel P(i,j) is 1, and the pixel data of two pixels P(i,j+1) and P(i,j+2) located above and adjacent to the target detection pixel P(i,j) is respectively 0 and 1, the display driver 110 also determines that the target detection pixel P(i,j) needs to be recoded, and recodes the target detection pixel P(i,j) with the original pixel data of 0 into the pixel data of 2. Namely, according to the judgement conditions of the third vertical code sequence 1001 of the table 3, in case that a part of the pixels in the target detection region i.e. the pixels P(i,j−1), P(i,j+1) and P(i,j+2) satisfy following conditions: the pixel data of the pixels P(i,j−1) and P(i,j+2) are 1 and the pixel data of the pixel P(i,j+1) is 0, the target detection pixel P(i,j) having the first code number 0 is recoded to have the third code number 2.

Figure 6H:
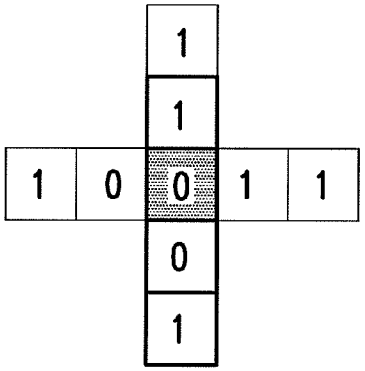

Moreover, regarding the operation method that the display driver determines whether the target detection pixel P(i,j) needs to be recoded by using the second vertical cod sequence and the fourth vertical code sequence shown in FIG. 6F and FIG. 6H, since those skilled in the art can learn enough instructions and recommendations of the above operation method from the descriptions of the embodiment of FIG. 6E and FIG. 6G, detailed description thereof is not repeated.

Therefore, according to the table 3 and the table 4, the code sequences serve as a plurality of judgement conditions of the present embodiment, and as long as the target detection pixel P(i,j) satisfies one of the judgement conditions, for example, as long as the target detection pixel P(i,j) satisfies one of the code sequences of the horizontal direction or the vertical direction, the display driver 110 accordingly determines that the target detection pixel P(i,j) needs to be recoded.

In FIG. 5B, the display driver 110 determines whether the target detection pixel P(i,j) in the target detection region 540 needs to be recoded according to a plurality of judgement conditions shown in the table 3 and the table 4. Therefore, in FIG. 5C, the target detection pixel P(i,j) displays the black color after recoding. Then, the display driver 110 determines whether the pixel data corresponding to the other display region of the image frame 300A needs to be recoded according to the judgement conditions shown in the table 2 and the table 3. The other display region includes but is not limited to other pixels of the image region 530. FIG. 5D illustrates a result that determinations of the other pixels of the image region 530 are completed, and at least a part of the pixel data is recoded. FIG. 5E illustrates an image frame 500E obtained by recoding a part of the pixel data of the image frame 500A of FIG. 5A. It should be noticed that a scan determination direction indicated in the image frame 500A of FIG. 5A is only an example, which is not used for limiting the invention.

In the embodiments of FIG. 3 to FIG. 6, the target detection regions 340 and 540 respectively have widths of one pixel and two pixels at each of two different sides of the target detection pixel P(i,j) along different pixel arranging directions while taking the target detection pixel P(i,j) as the center, though the invention is not limited thereto. In other embodiments, the width of the target detection region while taking the target detection pixel P(i,j) as the center can be three pixels or more. Namely, determination of the width of the target detection region of more than three pixels can also be implemented according to the judgement conditions similar to that of the aforementioned embodiments.

Figure 7:
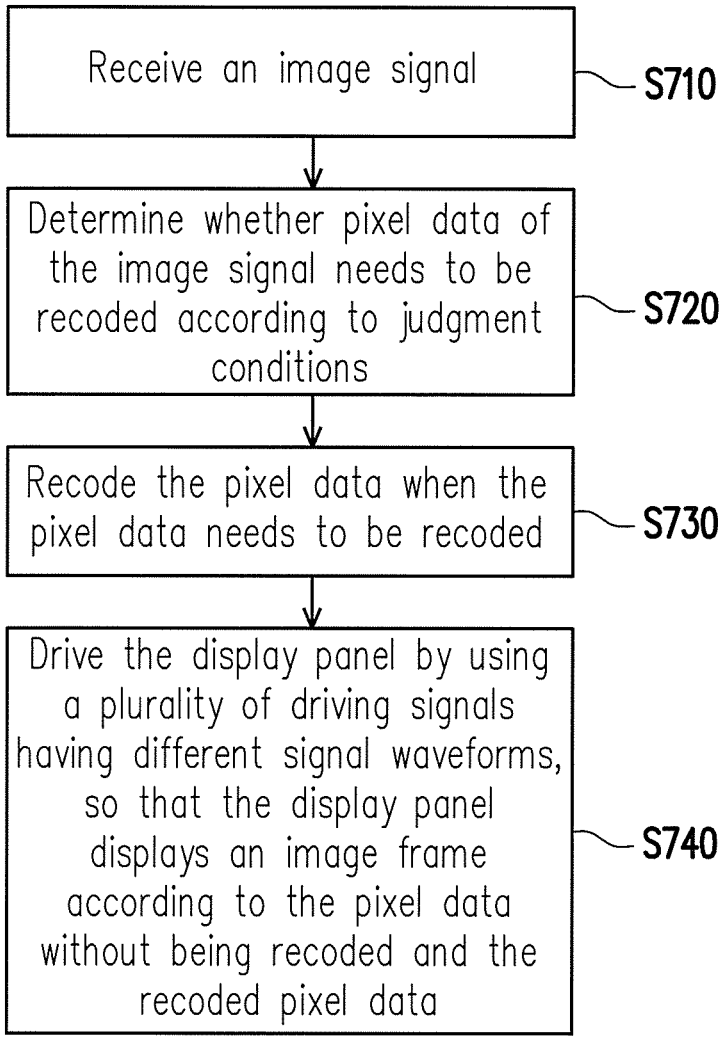
FIG. 7 is a flowchart illustrating an image processing method for an electrophoretic display apparatus according to an embodiment of the invention.

FIG. 7 is a flowchart illustrating an image processing method for an electrophoretic display apparatus according to an embodiment of the invention. Referring to FIG. 1 and FIG. 7, the image processing method of the present embodiment is at least adapted to the electrophoretic display apparatus 100 of FIG. 1, and includes following steps. In step S710, the display driver 110 receives the image signal SD. In step S720, the display driver 110 determines whether a plurality of pixel data of the image signal SD needs to be recoded according to at least one judgment condition. In step S730, if the pixel data needs to be recoded, the display driver 110 recodes the pixel data. In step S740, the display driver 110 drives the display panel 120 by using driving signals having different signal waveforms, so that the display panel 120 displays an image frame according to the pixel data without being recoded and the recoded pixel data. Details of the image processing method of the electrophoretic display apparatus may refer to the embodiments of FIG. 1 to FIG. 6, which are not repeated.

In summary, in the electrophoretic display apparatus and the image processing method of the invention, it is determined whether to recode the pixel data according to at least one judgement condition. The judgement condition includes but is not limited to a code sequence with a width of one or more pixels along the horizontal direction or the vertical direction. Moreover, in the electrophoretic display apparatus and the image processing method of the invention, the driving signals of different waveforms are used to drive the recoded pixel data, so as to improve the display quality.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An electrophoretic display apparatus, comprising:

a display panel; and a display driver configured to determine whether a plurality of pixel data of an image signal needs to be recoded according to one or more judgment conditions, and if the pixel data of the image signal needs to be recoded, the display driver recoding the pixel data, wherein the display driver drives the display panel by using a plurality of driving signals having different signal waveforms, so that the display panel displays an image frame according to the pixel data without being recoded and the recoded pixel data, wherein the driving signals comprise a first driving signal and a second driving signal, the display driver drives pixels by using the first driving signal for displaying the pixel data without being recoded, and the display driver drives pixels by using the second driving signal for displaying the recoded pixel data, wherein at least one pixel displays the pixel data without being recoded, and when displaying the image frame according to the same pixel data, the signal waveform of the first driving signal and the signal waveform of the second driving signal are different, where the second driving signal comprises an additional pulse during an equivalent time period in the signal waveforms for both the first and second driving signals.

2. The electrophoretic display apparatus as claimed in claim 1, wherein the one or more judgement conditions comprise at least one code sequence, and the at least one code sequence corresponds to the pixel data of at least a part of pixels in a target detection region of the image frame, the target detection region comprises a target detection pixel, and the display driver determines whether the pixel data of the target detection pixel needs to be recoded according to the at least one code sequence.

3. The electrophoretic display apparatus as claimed in claim 2, wherein the at least a part of pixels comprise the target detection pixel, and are arranged along a horizontal direction or a vertical direction in the target detection region.

4. The electrophoretic display apparatus as claimed in claim 2, wherein the target detection region has one or more pixel widths at each of two sides of the target detection pixel along a vertical direction and has the one or more pixel widths at each of two sides of the target detection pixel along a horizontal direction while taking the target detection pixel as a center.

5. The electrophoretic display apparatus as claimed in claim 2, wherein the at least one code sequence represents a gray level relationship between the pixel data of the target detection pixel and the pixel data of pixels adjacent to the target detection pixel.

6. The electrophoretic display apparatus as claimed in claim 1, wherein the first driving signal comprises a first display driving period, and the second driving signal comprises the first display driving period and a second display driving period.

7. The electrophoretic display apparatus as claimed in claim 6, wherein the pixel data without being recoded has a first code number and a second code number, and the recoded pixel data has a third code number and a fourth code number, wherein when the pixel data needs to be recoded, the display driver recodes the pixel data having the first code number into the pixel data having the third code number, and recodes the pixel data having the second code number into the pixel data having the fourth code number.

8. The electrophoretic display apparatus as claimed in claim 7, wherein during the first display driving period, the display driver drives the display panel to display the pixel data having the first code number and the pixel data having the second code number by using the first driving signal having different signal waveforms.

9. The electrophoretic display apparatus as claimed in claim 8, wherein during the first display driving period, the display driver drives the display panel to display the pixel data having the first code number and the pixel data having the third code number by using the first driving signal and the second driving signal having the same signal waveform, and the display driver drives the display panel to display the pixel data having the second code number and the pixel data having the fourth code number by using the first driving signal and the second driving signal having the same signal waveform.

10. The electrophoretic display apparatus as claimed in claim 7, wherein during the second display driving period, the display driver drives the display panel to display the pixel data having the third code number and the pixel data having the fourth code number by using the second driving signal having different signal waveforms.

11. An image processing method for an electrophoretic display apparatus, wherein the electrophoretic display apparatus comprises a display panel, the image processing method comprising:

receiving an image signal;

determining whether a plurality of pixel data of the image signal needs to be recoded according to one or more judgment conditions;

recoding the pixel data when the pixel data needs to be recoded; and driving the display panel by using a plurality of driving signals having different signal waveforms, so that the display panel displays an image frame according to the pixel data without being recoded and the recoded pixel data, wherein the driving signals comprise a first driving signal and a second driving signal, the display driver drives pixels by using the first driving signal for displaying the pixel data without being recoded, and the display driver drives pixels by using the second driving signal for displaying the recoded pixel data, wherein at least one pixel displays the pixel data without being recoded, and when displaying the image frame according to the same pixel data, the signal waveform of the first driving signal and the signal waveform of the second driving signal are different, where the second driving signal comprises an additional pulse during an equivalent time period in the signal waveforms for both the first and second driving signals.

12. The image processing method as claimed in claim 11, wherein the one or more judgement conditions comprise at least one code sequence, the at least one code sequence corresponds to the pixel data of at least a part of pixels in a target detection region of the image frame, and the target detection region comprises a target detection pixel, and the step of determining whether the pixel data needs to be recoded comprises:

determining whether the pixel data of the target detection pixel needs to be recoded according to the at least one code sequence.

13. The image processing method as claimed in claim 12, wherein the at least a part of pixels comprise the target detection pixel, and the at least a part of pixels are arranged along a horizontal direction or a vertical direction in the target detection region.

14. The image processing method as claimed in claim 12, wherein the target detection region has one or more pixel widths at each of two sides of the target detection pixel along a vertical direction and has the one or more pixel widths at each of two sides of the target detection pixel along a horizontal direction while taking the target detection pixel as a center.

15. The image processing method as claimed in claim 12, wherein the at least one code sequence represents a gray level relationship between the pixel data of the target detection pixel and the pixel data of pixels adjacent to the target detection pixel.

16. The image processing method as claimed in claim 11, wherein the first driving signal comprises a first display driving period, and the second driving signal comprises the first display driving period and a second display driving period.

17. The image processing method as claimed in claim 16, wherein the pixel data without being recoded has a first code number and a second code number, the recoded pixel data has a third code number and a fourth code number, and the step of recoding the pixel data comprises:

recoding the pixel data having the first code number into the pixel data having the third code number, and recoding the pixel data having the second code number into the pixel data having the fourth code number.

18. The image processing method as claimed in claim 17, wherein a step of driving the display panel to display the pixel data without being recoded by using the first driving signal comprises:

driving the display panel to display the pixel data having the first code number and the pixel data having the second code number by using the first driving signal having different signal waveforms during the first display driving period.

19. The image processing method as claimed in claim 18, wherein a step of driving the display panel to display the pixel data without being recoded by using the first driving signal and driving the display panel to display the recoded pixel data by using the second driving signal comprises:

driving the display panel to display the pixel data having the first code number and the pixel data having the third code number by using the first driving signal and the second driving signal having the same signal waveform during the first display driving period, and driving the display panel to display the pixel data having the second code number and the pixel data having the fourth code number by using the first driving signal and the second driving signal having the same signal waveform during the first display driving period.

20. The image processing method as claimed in claim 17, wherein a step of driving the display panel to display the recoded pixel data by using the second driving signal comprises:

driving the display panel to display the pixel data having the third code number and the pixel data having the fourth code number by using the second driving signal having different signal waveforms during the second display driving period.

* * * * *